US009106030B2

(12) United States Patent
Zahnen et al.

(10) Patent No.: US 9,106,030 B2
(45) Date of Patent: Aug. 11, 2015

(54) ELECTRICAL SERVICE DISCONNECT

(71) Applicants: James L. Zahnen, Ormond Beach, FL (US); Ronald Vallette, Ormond Beach, FL (US); Matthew D. Cawood, De Leon Springs, FL (US)

(72) Inventors: James L. Zahnen, Ormond Beach, FL (US); Ronald Vallette, Ormond Beach, FL (US); Matthew D. Cawood, De Leon Springs, FL (US)

(73) Assignee: Thomas & Betts International, LLC, Wilmington, DE (US)

( * ) Notice: Subject to any disclaimer, the term of this patent is extended or adjusted under 35 U.S.C. 154(b) by 88 days.

(21) Appl. No.: 14/048,803

(22) Filed: Oct. 8, 2013

(65) Prior Publication Data

US 2014/0099837 A1 Apr. 10, 2014

Related U.S. Application Data

(60) Provisional application No. 61/710,825, filed on Oct. 8, 2012.

(51) Int. Cl.

| | |
|---|---|
| ***H01R 24/00*** | (2011.01) |
| ***H01R 27/00*** | (2006.01) |
| ***H01R 43/26*** | (2006.01) |
| ***H01R 13/44*** | (2006.01) |
| ***H01R 13/639*** | (2006.01) |
| *H01R 4/18* | (2006.01) |

(52) U.S. Cl.

CPC ..... *H01R 27/00* (2013.01); *H01R 13/44* (2013.01); *H01R 13/6397* (2013.01); *H01R 43/26* (2013.01); *H01R 4/183* (2013.01); *Y10T 29/49204* (2015.01)

(58) Field of Classification Search

CPC ..... H01R 101/00; H01R 13/5219
USPC ..... 439/732, 271–274, 595, 685, 752
See application file for complete search history.

(56) References Cited

U.S. PATENT DOCUMENTS

| | | | | |
|---|---|---|---|---|
| 1,957,498 | A | 5/1934 | Hamill | |
| 2,521,722 | A * | 9/1950 | Hubbell et al. | 439/788 |
| 4,886,471 | A | 12/1989 | Fleshman Jr. | |
| 4,993,964 | A | 2/1991 | Trummer | |
| 5,033,973 | A | 7/1991 | Pruehs et al. | |
| 5,551,892 | A | 9/1996 | Endo et al. | |
| D380,732 | S * | 7/1997 | Saunders | D13/137.1 |
| 5,899,773 | A * | 5/1999 | Cheng | 439/651 |
| 5,997,320 | A | 12/1999 | DeMello | |
| 6,078,008 | A | 6/2000 | Wood et al. | |
| 6,663,405 | B1 | 12/2003 | Robinson et al. | |
| 6,808,418 | B2 | 10/2004 | Horner | |
| 7,458,846 | B2 | 12/2008 | Loehr et al. | |
| 7,905,748 | B2 | 3/2011 | Benke | |
| 8,876,562 | B2 * | 11/2014 | Glick et al. | 439/843 |
| 2010/0015827 | A1 | 1/2010 | Kobayashi | |

* cited by examiner

*Primary Examiner* — Phuongchi T Nguyen
(74) *Attorney, Agent, or Firm* — Butler Snow LLP

(57) ABSTRACT

An electrical disconnect for a utility service that has an internal reversible insulator and a separable power connector. In one position, the insulator may allow the flow of electricity through the separable power connector, but, in a second position, the insulator prevents the flow of electricity through the separable power connector. Because the electrical disconnect is located away from the customer's premises, it is difficult for the customer to reconnect his own power.

12 Claims, 4 Drawing Sheets

ELECTRICAL SERVICE DISCONNECT

CROSS-REFERENCES TO RELATED APPLICATIONS

This application claims the benefit of U.S. Provisional Application No. 61/710,825, filed Oct. 8, 2012, which is incorporated herein by reference in its entirety.

FIELD OF THE INVENTION

The present invention is generally directed to the field of electrical power, and, more particularly, to a method and device for disconnecting electrical service and reconnecting electrical service.

BACKGROUND OF THE INVENTION

Electric utility providers must occasionally disconnect a customer's electrical service for various reasons, including nonpayment, or because the customer is moving. The utility provider typically performs the disconnection by entering the customer's premises and removing the electric meter from its base. However, this can be dangerous for the lineman performing the task. For example, the customer may have an aggressive dog on the premises, or may even be hostile toward the lineman attempting to disconnect their service.

Some customers have attempted to reconnect their electricity by reconnecting the meter base or bypassing it. Not only are these attempts to reconnect service illegal, but they are also extremely dangerous.

SUMMARY OF THE INVENTION

We disclose a method and device for easily and discretely disconnecting electrical service at the utility service, such as the utility pole, pedestal, or underground terminal. The lineman, therefore, does not have to enter the customer's premises. Due to the discrete nature of the disconnection and the distance from the customer's premises, the customer cannot easily identify the location of where the electric utility is disconnected, and, therefore, will be hindered from reconnecting their own electrical service.

The device comprises a separable power connector, having a male mating portion and a female mating portion that can be separated from each other by a reversible insulator. In one position, the tubular-shaped reversible insulator allows the flow of electricity through the service cable, but, when reversed, it disrupts the flow of electricity through the cable.

BRIEF DESCRIPTION OF THE DRAWINGS

Further advantages of the invention will become apparent by reference to the detailed description of preferred embodiments when considered in conjunction with the drawings.

DETAILED DESCRIPTION

The following detailed description is presented to enable any person skilled in the art to make and use the invention. For purposes of explanation, specific details are set forth to provide a thorough understanding of the present invention.

However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

As will be appreciated from the attached figures, the electrical service disconnect 2 incorporates a separable power connector 6, such as a THOMAS & BETTS HOMAC® STORM-SAFE® connector, and a reversible insulator 4, which may be tubular-shaped. The separable power connector 6 is preferably located between the power conductors attached to the service entrance and power conductors attached to the utility side. Preferably, it is close to the utility side of the electrical service and is designed to be disconnected either manually, or as the result of sudden tension, such as from a falling tree or other storm debris. When disconnected, the conductors attached to the service entrance are not live, and, therefore, do not pose an electrical hazard.

Figure 2:
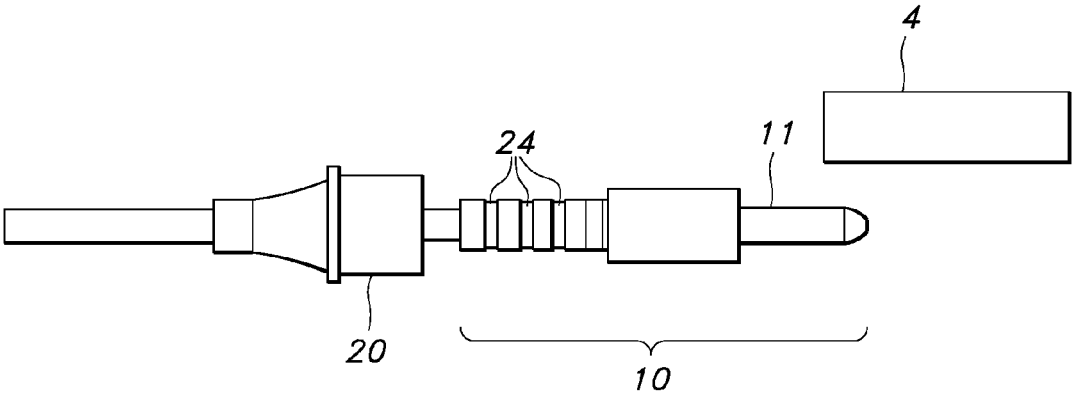
FIG. 2 depicts the male mating portion of the electrical service disconnect along with an uninstalled reversible insulator.
Figure 3:
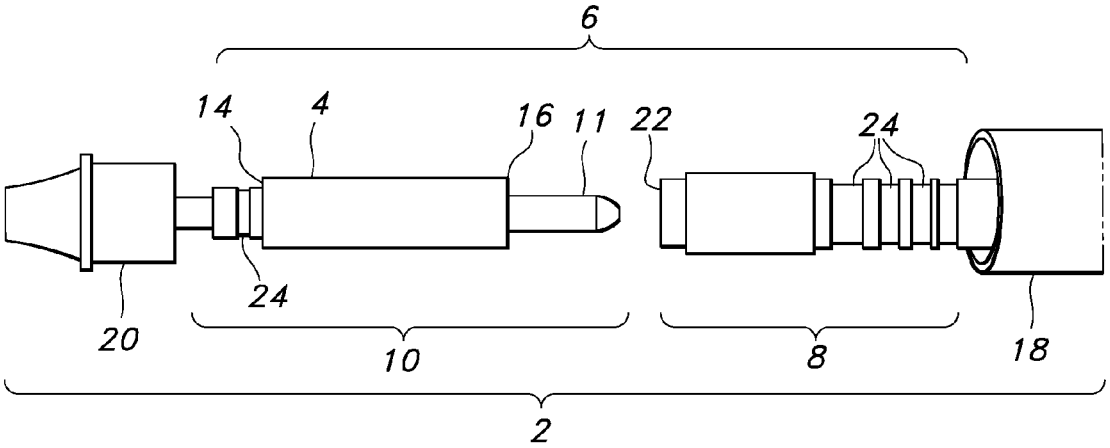
FIG. 3 depicts the electrical service disconnect with a reversible insulator installed on the male mating portion and oriented to allow the flow of electricity.

The separable power connector 6 itself may comprise a female mating portion 8 and a male mating portion 10. As can be seen in FIGS. 2 and 3, the male mating portion 10 includes a body with one end for attachment to a service cable and the opposite end having a protruding member 11. The female mating portion 8 includes a body having a hollow end 22 configured to receive the male mating portion 10 and the opposite end configured for attachment to the service cable coming from the utility, as shown in FIG. 3. The female mating portion 8 may be attached to the lead connected to the utility side conductor and the male mating portion 10 may be attached to the service entrance side conductor. The female mating portion 8 and the male mating portion 10 are secured to the service cable, preferably by crimping them directly onto their respective conductors, as crimping marks 24 can be seen in FIG. 2 on male mating portion 10 and in FIG. 3 on female mating portion 8.

Figure 1A:
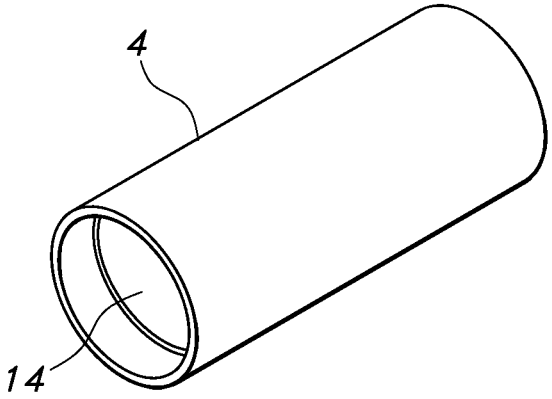
FIG. 1A depicts a perspective view of the reversible insulator.
Figure 1B:
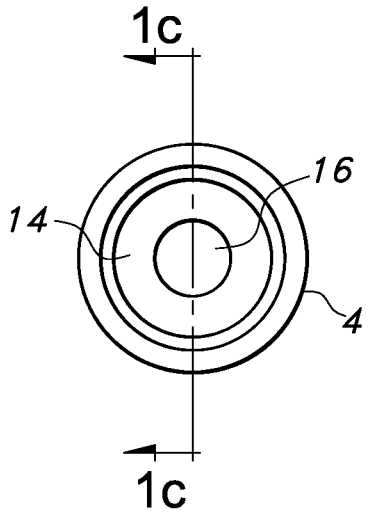
FIG. 1B depicts side elevation view of the reversible insulator.
Figure 1C:
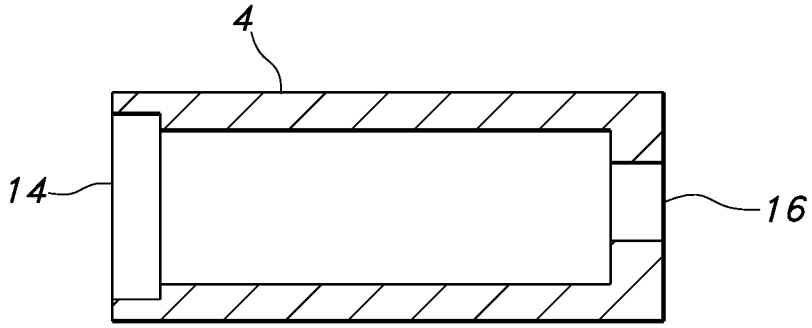
FIG. 1C depicts cross sectional view of the reversible insulator as viewed along line A-A of FIG. 1B.
Figure 4:
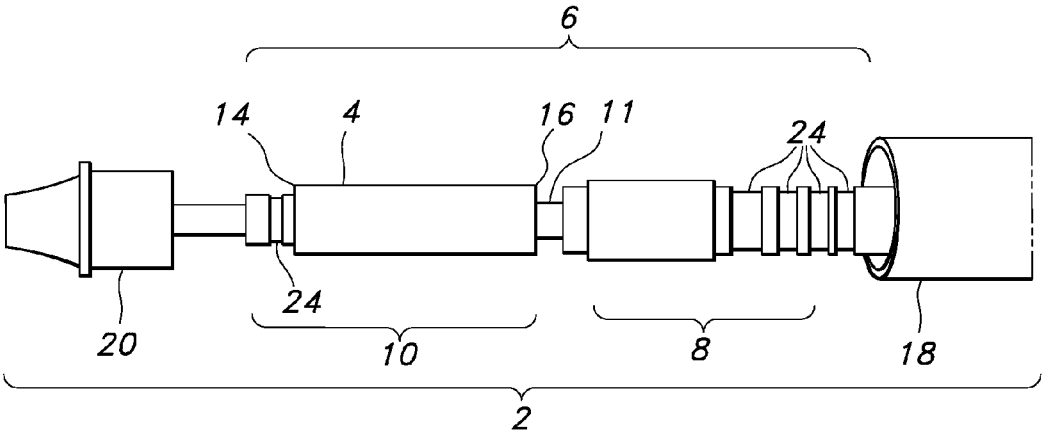
FIG. 4 depicts the electrical service disconnect with the male mating portion and female mating portion coupled with the reversible insulator oriented to allow the flow of electricity.

When the male mating portion 10 is in physical contact with the female mating portion 8, as shown in FIG. 4, electricity can be conducted through the cable. However, the electrical service disconnect 2 can also prevent electricity from being conducted through the cable by changing the orientation of the reversible insulator 4. As will be appreciated from FIGS. 1A-1C, the reversible insulator 4 is an elongated body having two openings at opposite ends. One opening, the insulator large opening 14, has an internal diameter large enough to accommodate the body of the male mating portion 10. The other opening, referred to herein as the insulator narrow opening 16, has a smaller internal diameter that is wide enough to accommodate only the protruding member 11 of the male mating portion 10, but not to accommodate the body of the male mating portion 10. The reversible insulator 4 may be made from any insulating material. In a preferred embodiment, the reversible insulator 4 is made from nylon. In more preferred embodiments, the reversible insulator 4 is made from plastic.

When the reversible insulator 4 is installed over the body of the male mating portion 10 with the protruding member 11 extending out through insulator narrow opening 16, as shown in FIGS. 3 and 4, the female mating portion 8 can engage with the protruding member 11. This direct contact will allow electricity to flow through the service cable to the customer's building.

Figure 5:
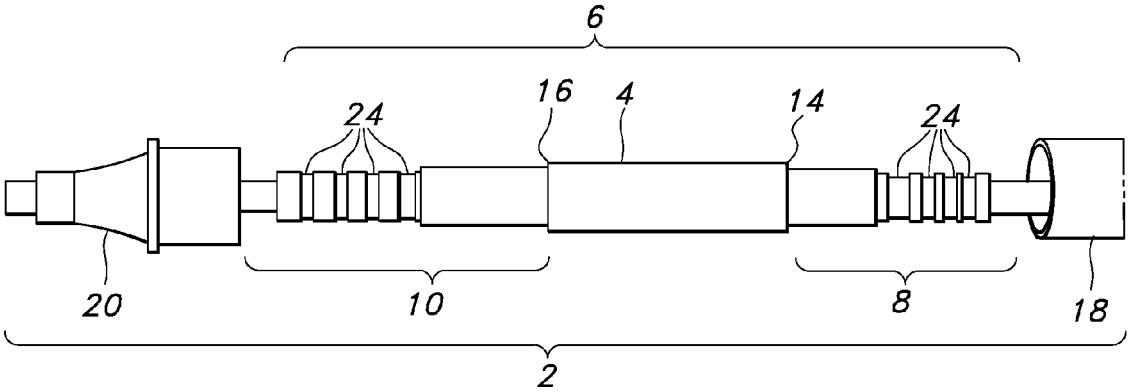
FIG. 5 depicts the electrical service disconnect with the male mating portion and female mating portion disconnected by the reversible insulator oriented to disrupt the flow of electricity.

The reversible insulator 4 may also be installed in the opposite orientation over the protruding member 11 so that only it is surrounded by the reversible insulator 4, as shown in FIG. 5. Due to the length of the reversible insulator 4, the protruding member 11 cannot make direct contact with the female mating portion 8.

Figure 6:
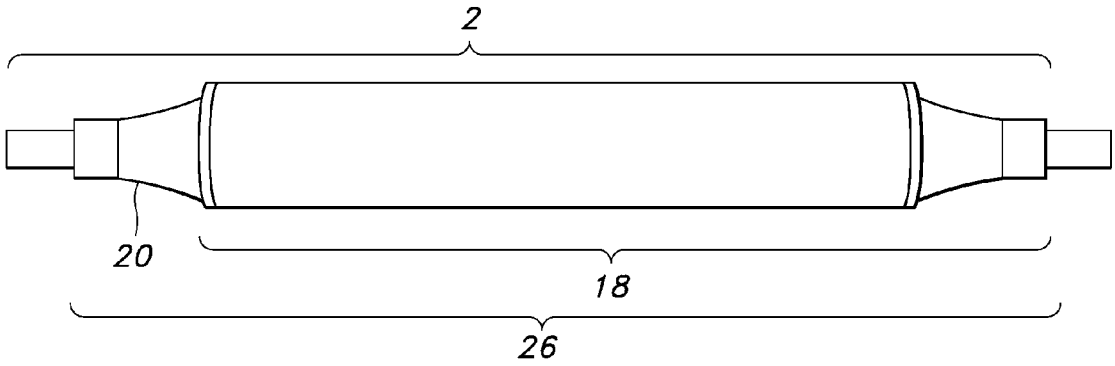
FIG. 6 depicts the electrical service disconnect encapsulated by the protective sheath.

The electrical disconnect 2, including the reversible insulator 4 and separable power connector 6, may also be further enclosed within a sheath 26 that protects the electrical components from being exposed to the weather. Additionally, it prevents the customer from seeing the orientation of the reversible insulator 4. Because the customer cannot see where the electrical circuit is disconnected, he is discouraged from attempting to reconnect it. The sheath comprises a sheath rocket 18 and a sheath cap 20. The sheath rocket 18 fits around the separable power connector 6 and has an opening through which at least a portion of the service cable protrudes. At the opposite end of the service cable, the sheath rocket 18 has an opening configured to engage with the wide end of the sheath cap 20. The sheath rocket 18 can be slid over the separable power connector 6 to engage with the sheath cap 20 to form a tight seal. The narrow end of the sheath cap 20 also includes an opening through which the service cable passes. As will be appreciated from FIG. 6, with the sheath rocket 18 engaged with sheath cap 20, the separable power connector 6 is fully encapsulated.

Installation of the electrical service disconnect 2 can be easily accomplished by a single lineman. Each of the phase cables will require their own separable power connector 6 in order to completely disconnect power. First, the tips of the sheath rocket 18 and sheath cap 20 are cut to accommodate the gauge of the service cable upon which it is being installed. Next, the service cables are cut, insulation is stripped, and the cables are penciled so that they can be accommodated into the ends of the separable power connector 6.

Silicon grease may then be applied to the utility side of the service cable, and the sheath rocket 18 is placed over the service cable. The silicon grease helps form a weatherproof seal. The female mating portion 8 is then placed over the bare wire of the service conductor and attached in place, preferably by crimping it, such as crimps 24. Silicon grease is then applied to the load side cable and the cable is inserted into the sheath cap 20. The male mating portion 10 is then placed over the bare wire of the service cable and attached in place, preferably by crimping, such as crimps 24.

The reversible insulator 4 is next placed over the protruding member 11 of the male mating portion 10 such that the protruding member 11 extends out from the reversible insulator 4. The protruding member 11 is then inserted into the female mating portion 8. The sheath rocket 18 and sheath cap 20 are then pushed together until the sheath rocket 18 is seated on the sheath cap 20.

To disconnect service, the sheath cap 20 is separated from the sheath rocket 18, thus exposing the separable power connector 6. The male mating portion 10 is then separated from the female mating portion 8, thus disrupting the flow of electricity. The reversible insulator 4 is removed from the male mating portion 10 and rotated such that the insulator narrow opening 16 faces the male mating portion 10. The reversible insulator 4 is then placed firmly over the protruding member 11 so that its length is surrounded by the reversible insulator 4. The sheath rocket 18 and sheath cap 20 are then pushed together over the separable power connector 6 until they once again form a tight seal.

When power needs to be restored, the sheath cap 20 is separated from the sheath rocket 18, thus exposing the separable power connector 6. The reversible insulator 4 is then removed from protruding member 11 and rotated such that the insulator large opening 14 faces the male mating portion 10. The reversible insulator 4 is then placed firmly over the male mating portion 10 such that protruding member 11 extends out from the reversible insulator 4. The sheath rocket 18 and sheath cap 20 are then pushed together over the separable power connector 6 until they once again form a tight seal.

It should be appreciated that the lineman does not need to carry insulators with him because the reversible insulator 4 is configured such that even when it is not disrupting the flow of electricity through the separable power connector 6, it is stored on the male mating portion 10.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

The invention has been described with reference to various specific and preferred embodiments and techniques. However, it should be understood that many variations and modifications may be made while remaining within the spirit and scope of the invention. It will be apparent to one of ordinary skill in the art that methods, devices, device elements, materials, procedures and techniques other than those specifically described herein can be applied to the practice of the invention as broadly disclosed herein without resort to undue experimentation. All art-known functional equivalents of methods, devices, device elements, materials, procedures and techniques described herein are intended to be encompassed by this invention. Whenever a range is disclosed, all subranges and individual values are intended to be encompassed. This invention is not to be limited by the embodiments disclosed, including any shown in the drawings or exemplified in the specification, which are given by way of example and not of limitation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

We claim:

1. A separable power connector for connecting a first power cable and a second power cable comprising:

a. a female mating portion comprising a body having a socket end and a female conductor end, wherein said female conductor end is capable of connecting to a first power cable and said socket end is configured to receive a protruding member;

b. a male mating portion comprising a body having a protruding member and a male conductor end, wherein said protruding member is configured to engage with said socket end and said male conductor end is capable of connecting to a second power cable; and c. an insulator having a first end with a narrow opening and a second end with a larger opening, said narrow opening having an inner diameter larger than said protruding member but smaller than said body of male mating portion and said larger opening capable of receiving said body of protruding member.

2. The separable power connector of claim 1 wherein said insulator is configured to be installed in a first direction over said protruding member to disconnect the flow of electricity and in a second direction over said body of male mating portion to permit the flow of electricity.

3. The separable power connector of claim 2 wherein said larger opening of insulator is capable of receiving said female mating portion.

4. The separable power connector of claim 1 wherein said female conductor end is able to be crimped to said first power cable.

5. The separable power connector of claim 1 wherein said male conductor end is able to be crimped to said second power cable.

6. The separable power connector of claim 1 wherein said insulator is made of plastic.

7. The separable power connector of claim 1 wherein said insulator is longer than said protruding member.

8. The separable power connector of claim 1 further comprising an insulating sheath capable of encapsulating said male mating portion, said reversible insulator, and said female mating portion.

9. A device for regulating electrical flow through a separable power connector comprising:

a male end with a protruding member extending from a body having a male conductor end and a male mating end, said separable power connector further comprising a reversible insulator having a narrow opening and a larger opening, said narrow opening having an inner diameter larger than said protruding member but smaller than said body of the male end, and said larger opening having a diameter larger than said body of the male end;

wherein said reversible insulator permits the flow of electricity through the separable power connector when the larger opening is placed over said body of the male end and said protruding member extends out through said narrow opening;

wherein said reversible insulator prevents the flow of electricity through the separable power connector when the narrower opening is placed over said protruding member and said larger opening faces away from said male end.

10. The device of claim 9 wherein said reversible insulator is made of plastic.

11. The device of claim 9 wherein said reversible insulator is made of nylon.

12. A method for interrupting the flow of electricity through a separable power connector comprising:

a. separating a male end of said separable power connector from a female end of said separable power connector;

b. removing an insulator partially surrounding the body of said male end of said separable power connector, wherein said insulator has a narrow opening and a larger opening;

c. reversing the direction of said insulator such that the narrow opening faces said male end and said larger opening faces said female end; and d. inserting at least a portion of the male end into said narrow opening;

e. the step of inserting at least a portion of said female end into said larger opening;

f. the step of encapsulating the separable power connector within a water-tight sheath.

* * * * *